US007934559B2

(12) United States Patent
Posevina et al.

(10) Patent No.: US 7,934,559 B2
(45) Date of Patent: May 3, 2011

(54) SINGLE CYCLE DART OPERATED CIRCULATION SUB

(75) Inventors: Lisa L. Posevina, Houston, TX (US); Gregory L. Hern, Huffman, TX (US)

(73) Assignee: Baker Hughes Incorporated, Houston, TX (US)

( * ) Notice: Subject to any disclaimer, the term of this patent is extended or adjusted under 35 U.S.C. 154(b) by 263 days.

(21) Appl. No.: 11/705,367

(22) Filed: Feb. 12, 2007

(65) Prior Publication Data

US 2008/0190620 A1 Aug. 14, 2008

(51) Int. Cl.
*E21B 34/06* (2006.01)

(52) U.S. Cl. ..... 166/318; 166/154; 166/334.4

(58) Field of Classification Search ..... 166/318, 166/334.4, 154; 175/237, 317
See application file for complete search history.

(56) References Cited

U.S. PATENT DOCUMENTS

| | | | | |
|---|---|---|---|---|
| 2,797,755 | A | 7/1957 | Bobo | |
| 2,925,865 | A * | 2/1960 | Oliver | 166/154 |
| 3,198,256 | A | 8/1965 | Kirby | |
| 3,280,923 | A | 10/1966 | Muench | |
| 3,712,115 | A | 1/1973 | Miller | |
| 3,969,937 | A | 7/1976 | Barrington et al. | |
| 4,176,717 | A * | 12/1979 | Hix | 166/289 |
| 4,452,313 | A | 6/1984 | McMahan | |
| 4,458,762 | A | 7/1984 | McMahan | |
| 4,469,174 | A | 9/1984 | Freeman | |
| 4,520,870 | A * | 6/1985 | Pringle | 166/317 |
| 4,809,793 | A | 3/1989 | Hailey | |
| 5,014,780 | A | 5/1991 | Skipper | |
| 5,123,489 | A | 6/1992 | Davis et al. | |
| 5,176,208 | A | 1/1993 | Lalande et al. | |
| 5,265,675 | A | 11/1993 | Hearn et al. | |
| 5,287,930 | A | 2/1994 | McGill | |
| 5,320,176 | A | 6/1994 | Naquin et al. | |
| 5,375,662 | A * | 12/1994 | Echols et al. | 166/386 |
| 5,402,850 | A | 4/1995 | Lelande et al. | |
| 5,499,687 | A * | 3/1996 | Lee | 175/317 |
| 5,765,640 | A | 6/1998 | Milne et al. | |

(Continued)

FOREIGN PATENT DOCUMENTS

GB 2272923 6/1994

(Continued)

OTHER PUBLICATIONS

MFCT, Mechanical Wellbore Cleanup: Circulating Sub (Weight); Heavy Duty Clutch Type; SPS International 2006, 2 pps.

(Continued)

*Primary Examiner* — David J Bagnell
*Assistant Examiner* — David Andrews
(74) *Attorney, Agent, or Firm* — Steve Rosenblatt

(57) ABSTRACT

A circulating sub is run in with the circulating port closed. A dart blocks a central passage and moves two concentric pistons in tandem to open the circulation port while retaining the dart. The outer piston shoulders out in the circulation port open position. A second dart lands on the first and with applied pressure moves the inner piston relative to the shouldered outer piston to close the circulation port and only then discharge both darts. Subs can be used in tandem as long as higher located subs accept larger darts than lower subs and preferably the two darts for each sub are the same size. The ejected darts can be used to pressure actuate a downhole tool like a packer.

20 Claims, 8 Drawing Sheets

U.S. PATENT DOCUMENTS

| | | | | |
|---|---|---|---|---|
| 5,881,816 | A | 3/1999 | Wright | |
| 6,102,060 | A | 8/2000 | Howlett et al. | |
| 6,152,220 | A | 11/2000 | Carmichael et al. | |
| 6,152,221 | A | 11/2000 | Carmichael et al. | |
| 6,152,228 | A | 11/2000 | Carmichael | |
| 6,176,311 | B1 | 1/2001 | Ryan | |
| 6,220,357 | B1 | 4/2001 | Carmichael et al. | |
| 6,227,291 | B1 | 5/2001 | Carmichael et al. | |
| 6,250,387 | B1 | 6/2001 | Carmichael et al. | |
| 6,253,861 | B1 | 7/2001 | Carmichael et al. | |
| 6,276,452 | B1 | 8/2001 | Davis et al. | |
| 6,279,657 | B1 | 8/2001 | Carmichael et al. | |
| 6,305,469 | B1 | 10/2001 | Coenen et al. | |
| 6,431,292 | B2 | 8/2002 | Mocivnik et al. | |
| 6,454,009 | B2 | 9/2002 | Carmichael et al. | |
| 6,478,088 | B1 | 11/2002 | Hansen et al. | |
| 6,719,052 | B1 | 4/2004 | Harmon et al. | |
| 6,776,231 | B2 | 8/2004 | Allen | |
| 6,896,074 | B2 | 5/2005 | Cook et al. | |
| 6,951,251 | B2 | 10/2005 | Penisson | |
| 7,108,067 | B2 * | 9/2006 | Themig et al. | 166/317 |
| 7,188,675 | B2 | 3/2007 | Reynolds | |
| 7,264,047 | B2 | 9/2007 | Brezinski et al. | |
| 7,467,664 | B2 | 12/2008 | Cochran et al. | |
| 7,467,665 | B2 | 12/2008 | Mackenzie | |
| 2002/0104649 | A1 | 8/2002 | Allen | |
| 2002/0112862 | A1 | 8/2002 | Patel | |
| 2002/0162655 | A1 | 11/2002 | Lynde et al. | |
| 2005/0217864 | A1 | 10/2005 | Carmichael | |

FOREIGN PATENT DOCUMENTS

| | | |
|---|---|---|
| GB | 2335687 | 9/1999 |
| WO | WO2004/088091 | * 10/2004 |

OTHER PUBLICATIONS

Baker Hughes, Baker Oil Tools, Circulation Control Joint Technical Information, Oct. 1, 2003, 1 page.

Baker Hughes, Baker Oil Tools, Pump Out Sub Technical Information, Jun. 7, 2005, 1 page.

BJ Services Company, Dual Ball-Drop Circulating Sub Product Information, Apr. 11, 2006, 1 page.

Coronado, Martin P., et al., "Next-Generation Sand Screen Enables Drill-In Snadface Completions", SPE 113539, Jun. 2008, 1-13.

Chapman, Walt, "Using Monobore System to Lower Completion Costs in Short-Life Wells", SPE 113315, Jun. 2008, 1-7.

Augustine, Jody, et al., "World's First Gravel-packed Inflow-Control Completion", SPE 103195, SPE Drilling and Completion, Mar. 2008, 61-67.

* cited by examiner

SINGLE CYCLE DART OPERATED CIRCULATION SUB

FIELD OF THE INVENTION

The field of this invention is downhole circulation valves that can be opened and closed with dropped objects and more particularly to valves that can open and close without having to use a larger object for a second position of the valve.

BACKGROUND OF THE INVENTION

There are many operations downhole that require circulation or reverse circulation through a tool string. Almost as often the circulation valve needs to be operated between two positions so that, for example, it can be run in open to the desired location and then after the circulation is done, it can be closed again.

There are many types of circulation valves that are in use downhole. Some have an internal ported sleeve that is attached to a housing with a port through a j-slot mechanism. With this type of valve picking up and setting down weight gets the ports aligned or misaligned, as needed. These types of valves are less suitable for deviated wellbores where it is difficult to know if picking up and setting down has actually shifted the circulation valve or merely stretched the tubing string from a location near a wellbore deviation.

Other types of circulation valves involve the use of ever larger balls to move a circulation valve between its end positions. This design allows an initial smaller ball to land on a seat to pressure up to set another tool followed by a further pressure to move the valve to another position. In order to move the valve again to its initial position a bigger ball has to land on a bigger seat to, for example, shift a different sleeve. The initial ball is typically released as its seat shifts into a recess and opens up. Such seats can be made of collet segments that are held together in an initial position to allow pressure buildup on a seated ball and then the collet fingers in a groove can spread apart allowing the ball to go on through.

As an alternative, a different seat has been employed that simply enlarges as the ball is blown though it with pressure. It then stands ready to receive another ball that is larger for another operation.

A circulation valve with disappearing balls has been offered. The idea here is to use a seat that keeps its dimension so that it can accept a constant ball size. The idea is that the ball lands on the seat and permits whatever operation is needed and then just goes away from exposure to well conditions over time. The problem with this design is that the balls are rather soft and are prone to be eroded during delivery or even when on the ball seat itself and before the operation that depends on the ball sealing can be accomplished.

Other issues that have affected ball seats made of a series of collets is that the sealing happens on a series of abutting shoulders and in a downhole environment where debris can settle on the seating surface and reduce the chance for a good seal on the ball. Additionally, the collets have some gaps between them where some of the applied pressure creates a bypass flow that inhibits the desired shifting movement of a sleeve.

Recently a solution was proposed in U.S. application Ser. No. 11/583,678 filed Oct. 19, 2006 that is also assigned to Baker Hughes Inc. That solution featured a circulating sub that could be opened with a first ball for circulation and the circulation port closed with a second ball that was preferably of the same size as the first ball. In that design as each movement occurred, the ball causing the movement was ejected. Some customers did not want the first ball ejected before it was time to set a packer below. The release of the initial ball that opened the circulation port could lodge in the packer below and cause it to set prematurely. Apart from that concern, there was another concern of available momentum for the initial movement to allow full circulation port opening. On some occasions either because a bypass flow around the ball at the seat made of adjacent collet heads or because of a braking effect of O-rings being run past recently sheared pin remnants, the initial movement to fully open the circulation port would not complete before the initial ball was ejected.

The present invention improves the above design. It uses concentric pistons with the inner piston having a series of collet fingers that form a seat to accept a dart. The circulation sub is run in with the circulation port closed. The first dart lands on the collet heads and shifts both pistons in tandem to open the circulation port while retaining the dart. A second dart lands on the first dart and a higher seat on the inner piston. Pressure buildup on the second dart shifts the inner piston with respect to the shouldered outer piston to close the circulation ports and eject both darts to a catcher below. On the way, the darts can be used to set a downhole tool such as a packer before winding up in the dart catcher. The circulation subs are modular and can be used in stacks with progressively larger darts to operate subsequent modules located uphole. These and other aspects of the present invention will become more apparent to those skilled in the art from a review of the description of the preferred embodiment and associated drawings while recognizing that the claims define the full scope of the invention.

SUMMARY OF THE INVENTION

A circulating sub is run in with the circulating port closed. A dart blocks a central passage and moves two concentric pistons in tandem to open the circulation port while retaining the dart. The outer piston shoulders out in the circulation port open position. A second dart lands on the first and with applied pressure moves the inner piston relative to the shouldered outer piston to close the circulation port and only then discharge both darts. Subs can be used in tandem as long as higher located subs accept larger darts than lower subs and preferably the two darts for each sub are the same size. The ejected darts can be used to pressure actuate a downhole tool like a packer.

DETAILED DESCRIPTION OF THE DRAWINGS

FIG. 1 shows a circulation sub with the port closed for run in;

FIGS. 5*a*-5*f* show an assembly of two circulating subs with a packer with a lock released so the packer can be actuated;

FIGS. 6*a*-6*f* show the view of FIGS. 5*a*-5*f* with the packer set by string manipulation.

DETAILED DESCRIPTION OF THE PREFERRED EMBODIMENT

Figure 1:
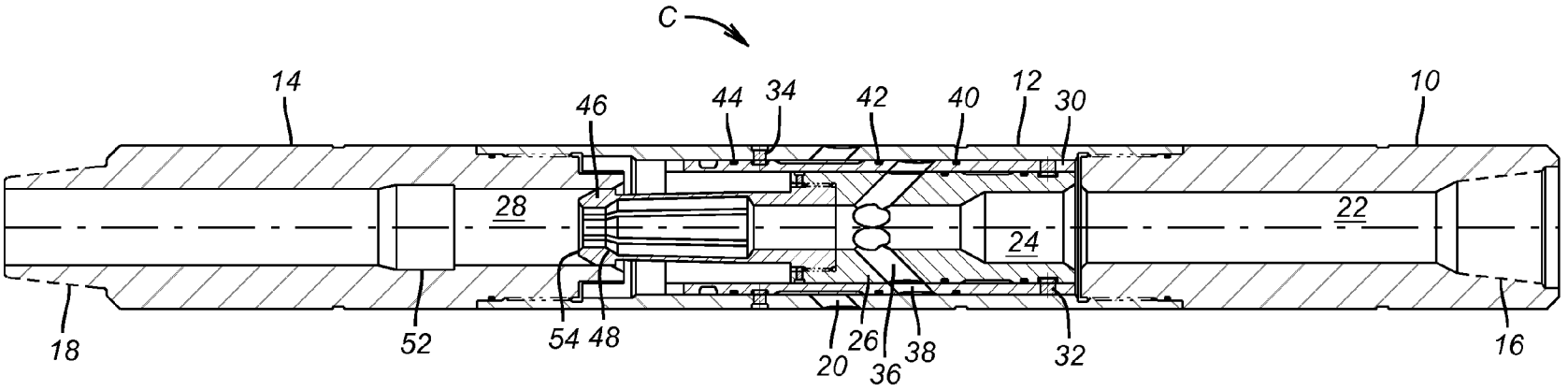

FIG. 1 illustrates the circulation sub C of the present invention in the run in position. It has a top sub 10 attached to a ported sub 12 which is in turn attached to a bottom sub 14. Thread 16 connects to the string above (not shown). Located above circulation sub C can be other subs that operate just like it but with larger diameter darts.

Thread 18 is used to secure a lower string which can include a packer and dart catchers as will be described below. Ported sub 12 has a port 20. A through passage in circulation sub C comprises an upper passage 22 in top sub 10. Passage 24 in inner piston 26 is the continuation of passage 22. Finally, passage 28 in bottom sub 14 marks the lower end of the through bore in the circulation sub C.

Figure 2:
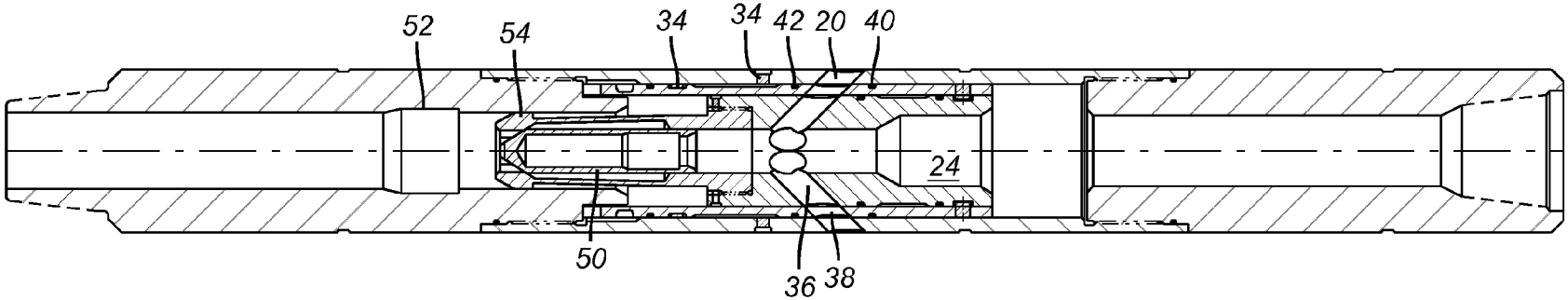
FIG. 2 is the view of FIG. 1 with a first dart landed and the concentric pistons moved in tandem for a circulation ports open position.
Figure 3:
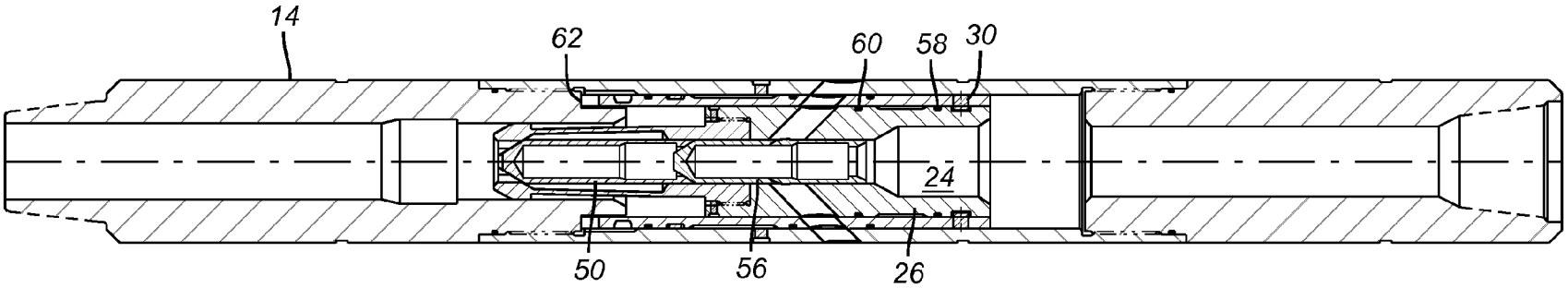
FIG. 3 is the view of FIG. 2 with a second dart landed and the circulation ports still aligned but blocked by the second dart.
Figure 4:
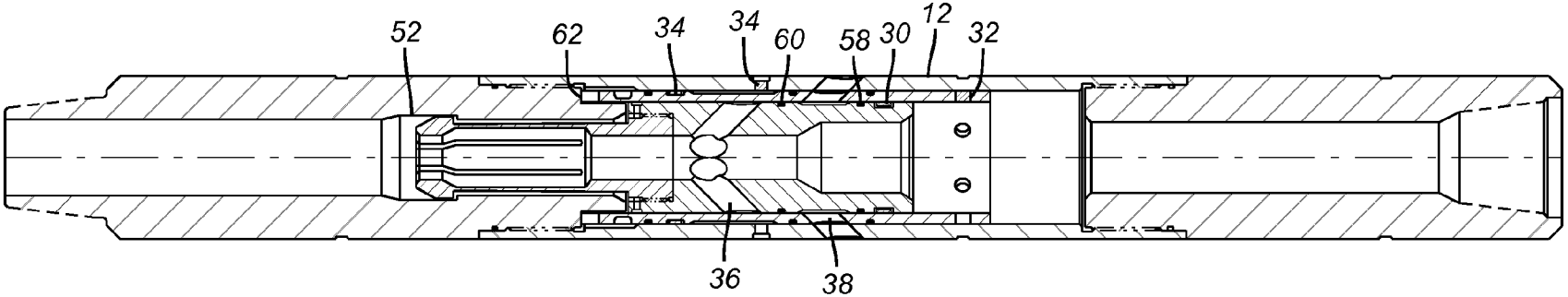
FIG. 4 is the view of FIG. 3 with the inside piston shifted relative to the stationary outer piston to close the circulation ports and eject both darts from the sub.
Figure 5A:
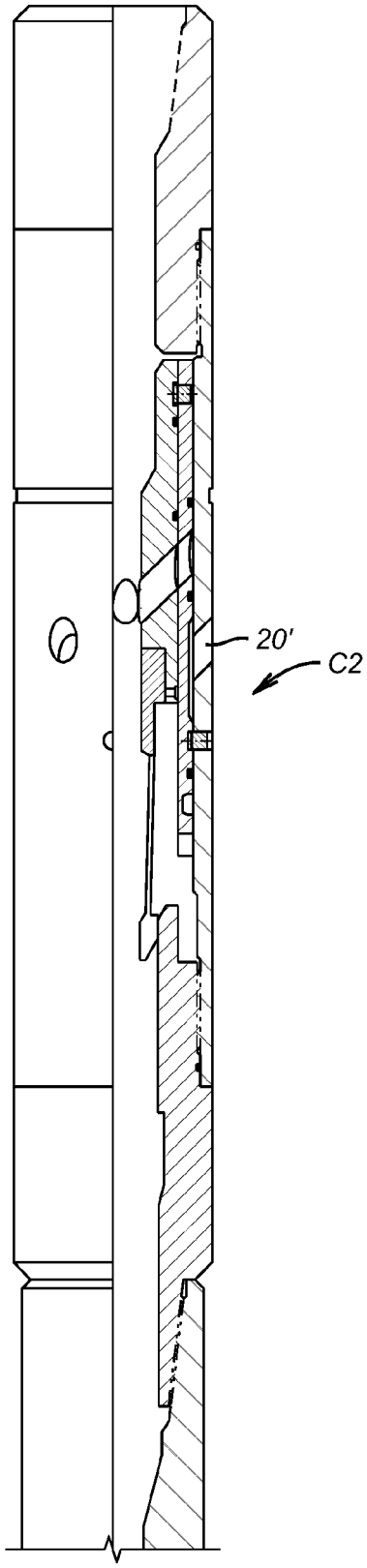
Figure 6A:
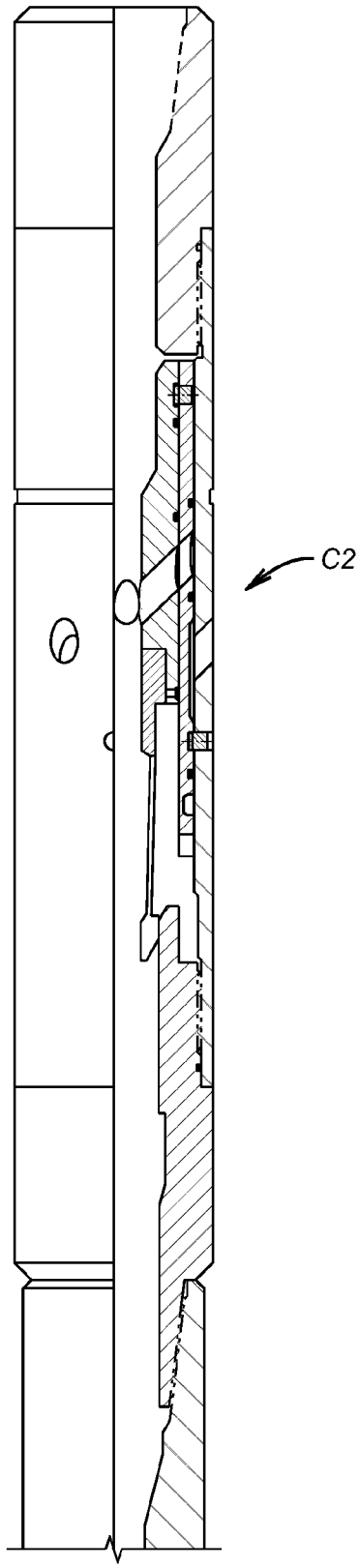
Figure 5B:
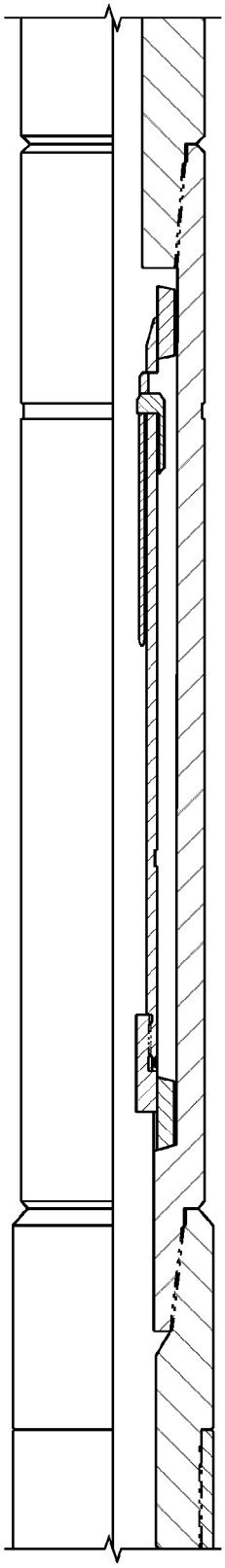
Figure 6B:
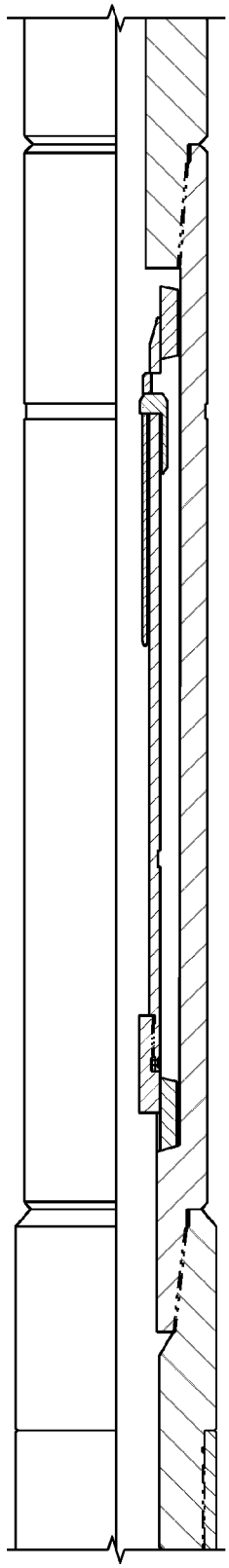
Figure 5C:
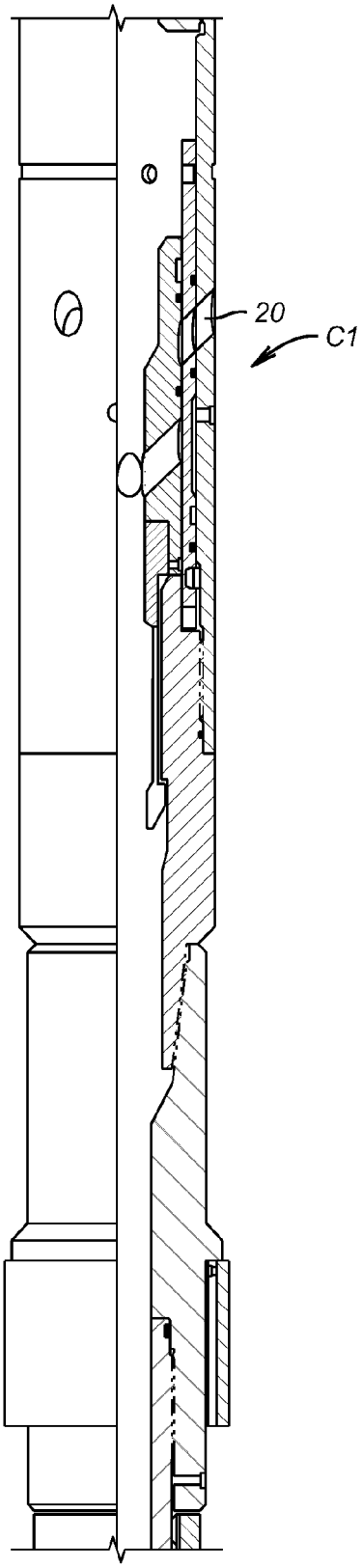
Figure 6C:
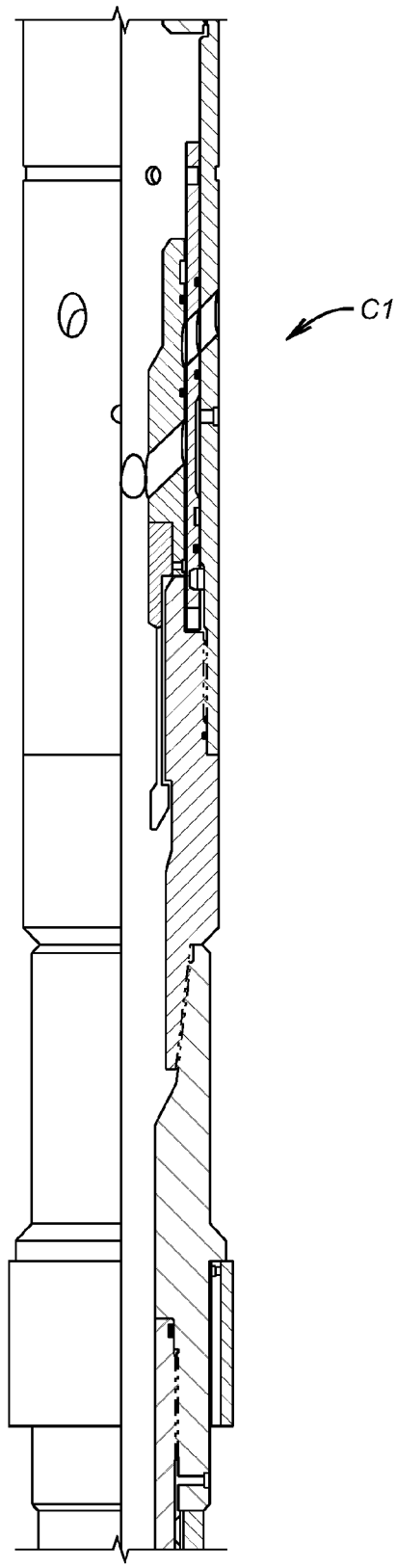
Figure 5D:
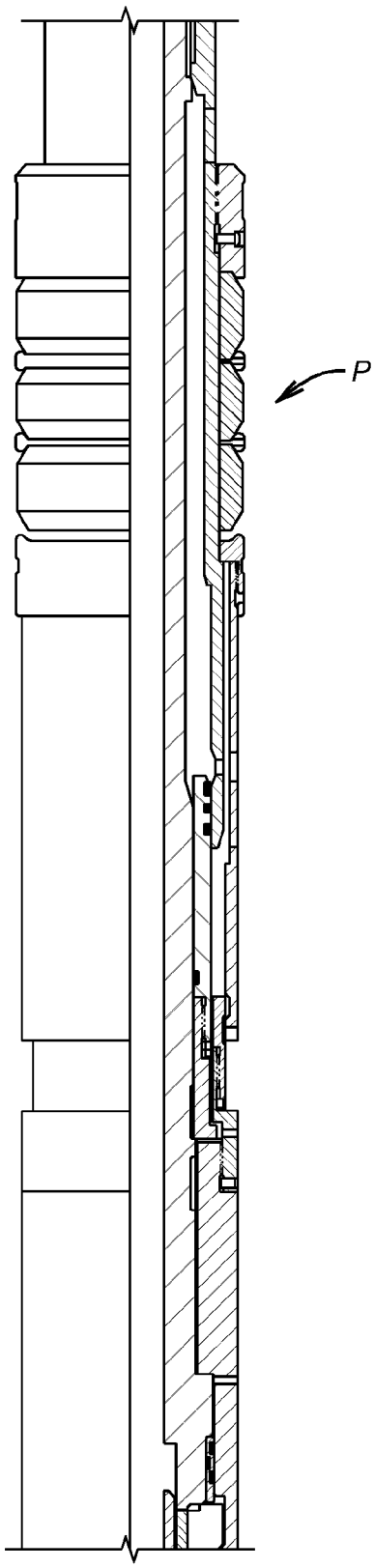
Figure 6D:
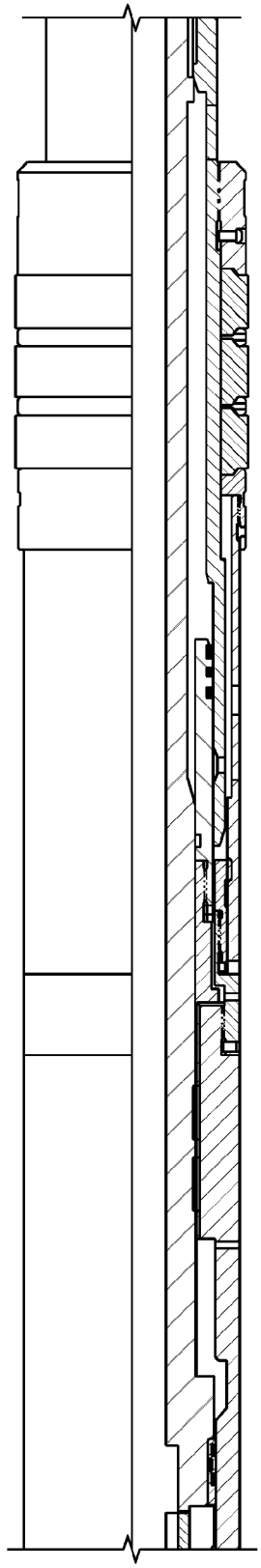
Figure 5E:
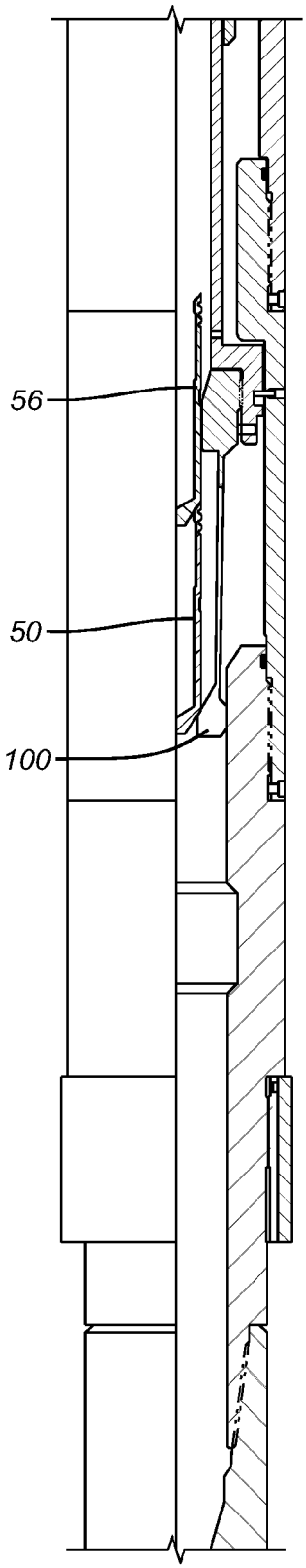
Figure 6E:
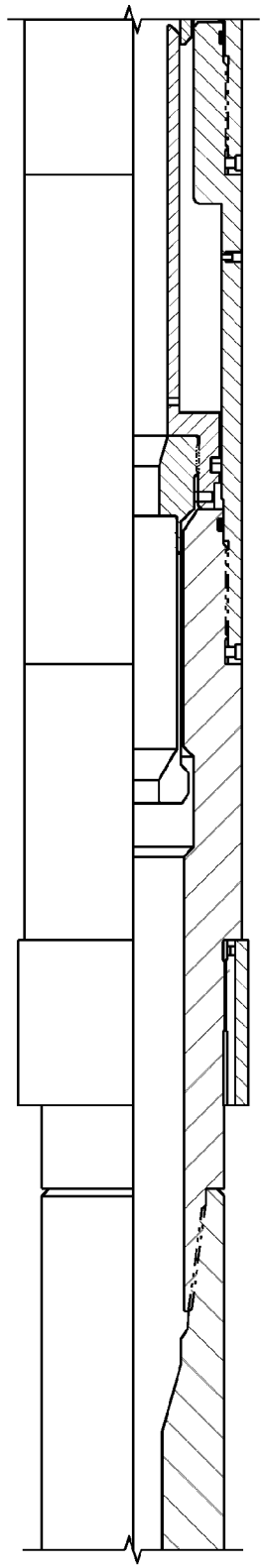
Figure 5F:
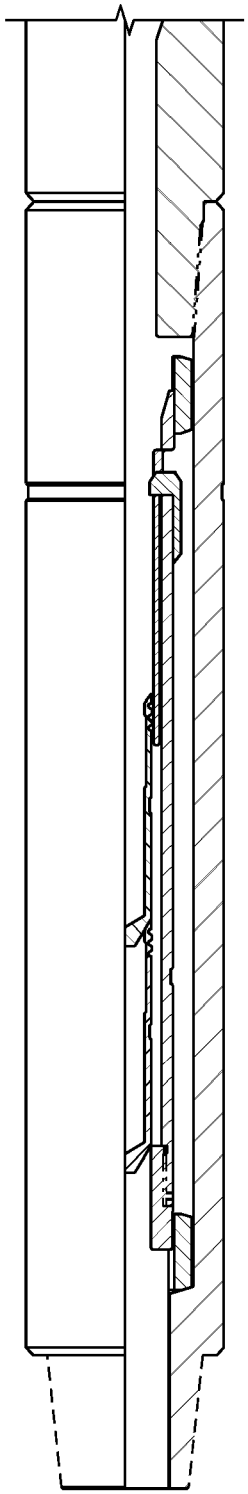
Figure 6F:
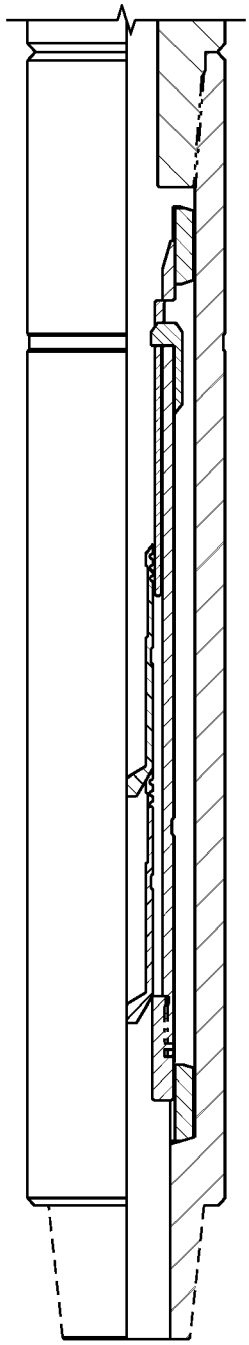

Outer piston 30 is concentric with inner piston 26 and they are held together by one or more shear pins 32. Outer piston 30 is also held to ported sub 12 by one or more shear pins 34 that are preferably weaker than pins 32. In the run in position of FIG. 1, the port 20 in ported sub 12 is isolated from aligned passages 36 in the inner piston 26 and 38 in the outer piston 30. Seals 40 and 42 straddle passage 38 in the outer piston 30 and isolate passages 36 and 38 from outlet port 20. Seal 44 is located on the outside of outer piston 30 and on the other side of port 20 in the run in position to seal between the ported sub 12 and the outer piston 30. Inner piston 26 ends in collet fingers 46 that form a seat 48 to accept the first dart 50, see FIG. 2. Passage 28 has an enlarged portion 52 that eventually will receive the collet heads 54 to release dart 50 and dart 56 above it, see FIGS. 3 and 4. Seals 58 and 60, see FIGS. 3 and 4, are on inner piston 26 and are used to close off port 20 when the inner piston 26 is shifted relative to the already shifted outer piston 30. Seals 58 and 60 do this by straddling passage 38 while it is offset from passage 36.

The significant parts having been described, the operation of the circulation sub C will now be explained. During the run in position of FIG. 1, pins 34 hold the outer piston 30 to the ported sub 12. Pins 32 hold the inner piston 26 to the encircling outer piston 30. A dart 50 is dropped to land on seat 48 formed by collet heads 54 supported against radial movement by the bore 28. Pressure is built up on the dart 50 as shown in FIG. 2 until the shear pins 34 shear out. The pistons 26 and 30 move in tandem until the outer piston 30 hits shoulder 62 on bottom sub 14. At this time, as shown in FIG. 2 port 20 is aligned with passages 36 and 38 and seals 40 and 42 straddle port 20 so that the circulation sub C is in position for circulation. The dart 50 is retained trapped by collet heads 54. Collet heads 54 have moved with inner piston 26 but are still shy of the enlarged portion 52. Note that seal 42 has not had to move beyond broken shear pin portion 34 that stays in ported sub 12. Also note that dart 50 fully obstructs passage 24 and is still retained to the collet heads 54 when the FIG. 2 position for circulation is reached.

After the requisite circulation is done, it is time to close the port 20. FIG. 3 shows dart 56 landed on dart 50 and blocks passage 24 and port 20 fully. Now pressure is built up to a higher level than when shear pins 34 were broken. The outer piston 30 has shouldered out against surface 62 of bottom sub 14 and can't move any further. Pressure buildup breaks shear pin 32 to let the inner piston 26 move down until the collet heads 54 go into enlarged portion 52 where they can be spread radially to the point that the darts 50 and 56 can be blown out of the circulating sub C. Passage 36 has moved out of alignment with passage 38 leaving a solid portion of inner piston 26 against passage 38 with seals 58 and 60 straddling passage 38 to isolate it from passage 36. The circulating sub C has thus been cycled from closed to open and back to closed.

While one circulating sub C has been illustrated, those skilled in the art will appreciate that if circulation ports need to be opened and closed more than once, then multiple circulating subs can be used in tandem, as shown in FIGS. 5*a*-5*f* and 6*a*-6*f*. If that is done, the lowermost sub C1 will need to have the smallest darts so that they can pass any higher subs, such as C2, without getting hung up or actuating them. In the preferred embodiment, the darts 50 and 56 that operate an individual sub C are preferably the same size but they don't need to be. Dart 50 or dart 56 or both of them, when ejected from a lowermost sub C1 can be landed in a catcher or other mechanism 100 (see FIG. 5*e*) that is in or below a tool such as a packer P, so that it can allow a subsequent pressure buildup against that packer or string manipulation, for example, to set packer P (FIG. 6*d*) when the circulation port 20 in sub C1 has been re-closed as described above. Other tools can be pressure actuated in the same manner. The darts 50 and 56 go past catcher 100 after enabling packer P to be set. After packer P is set, the upper sub C2 can be operated in the same manner, but with bigger darts to open and close the upper circulation port 20' as needed.

The sub C can be opened for circulation without release of the dart 50. It is not until the port 20 is closed that both darts 50 and 56 get released as collet heads 54 move into the enlarged segment 52 in passage 28. Note also that upon opening of port 20, seal 42 is positioned so that it does not run past the now sheared remnant of pin or pins 34. One reason the prior design may have hung up before fully opening is that the o-ring seal was positioned so that on opening the circulation sub for circulation mode, the seal had to be driven past the sheared remnant of a shear pin. While darts are described, other shapes or objects that substantially block the through flow passage are preferred. It is preferred that the object be long enough or positioned to seal at a location to seal the gaps between the collet fingers that will form its seat so that pressure from uphole can be applied onto the dart with little to no bypassing flow. While a seat from collet heads is described other styles of seats against which the object sits as it is pressured up are also contemplated if they are configured to retain the object as the sub C changes position after run in. The other feature would be release of the object or objects with the second change in position. While the orientation of passage 36 is shown in the figures as in the uphole direction the orientation can be either radial or downhole.

The above description is illustrative of the preferred embodiment and many modifications may be made by those skilled in the art without departing from the invention whose scope is to be determined from the literal and equivalent scope of the claims below.

We claim:

1. At least one circulation sub for mounting on a string for subterranean use, comprising:

a body having a through passage and at least one lateral port and a valve member for selective first movement, without rotation, for opening and a second movement, without rotation, in the same direction as said first movement for closing said lateral port;

said valve member operable to open said lateral port when one object is placed in contact with a seat on said valve member and to close said lateral port with another object landed on said first object so that both objects are supported on said seat of said valve member;

said seat of said valve member releasing only said objects from contact with said valve member upon said second movement of said valve member that enlarges said seat.

2. The at least one sub of claim 1, wherein:

said movements represent the open and closed positions of said lateral port.

3. The at least one sub of claim 2, wherein:

part of said through passage passes through said seat on said valve member.

4. The at least one sub of claim 3, wherein:
said valve member has a lateral passage selectively aligned with said lateral port.

5. The at least one sub of claim 4, wherein:
said valve member comprises an inner and an outer tubular with a respective inner and outer lateral passages in a wall thereof.

6. The at least one sub of claim 5, wherein:
said inner and outer tubulars are selectively restrained by a first restraint to said body.

7. The at least one sub of claim 6, wherein:
said inner and outer tubulars movable in tandem when said first restraint is overcome with pressure applied to at least one of said objects on said seat.

8. The at least one sub of claim 7, wherein:
said seat is mounted to said inner tubular and retains its dimension when said inner and outer tubulars move in tandem.

9. The at least one sub of claim 8, wherein:
said inner and outer tubulars are selectively restrained by a second restraint to each other.

10. The at least one sub of claim 9, wherein:
said outer tubular has a travel stop on said body such that said second restraint breaks after said outer tubular engages said travel stop.

11. The at least one sub of claim 10, wherein:
said second object contacts said inner tubular to isolate said lateral port by closing said through passage;
said second restraint is broken when pressure is applied to said second object with said outer tubular against said stop.

12. The at least one sub of claim 11, wherein:
movement of said inner tubular relative to said outer tubular allows said seat to change dimension to release said objects.

13. The at least one sub of claim 12, wherein:
said seat comprises a tapered seating surface formed by collet heads that become unsupported by movement of said inner tubular with respect to said outer tubular.

14. The at least one sub of claim 13, wherein:
said collet heads move into a wide portion of said through passage to release said objects.

15. The at least one sub of claim 14, wherein:
said objects comprise darts that are the same size.

16. The at least one sub of claim 7, wherein:
said outer tubular has a travel stop on said body and at least one seal such that when said seal is moved across said lateral port, it stops short of said first restraint.

17. The at least one sub of claim 1, wherein:
said objects are the same size.

18. The at least one sub of claim 17, wherein:
said objects comprise darts.

19. The at least one sub of claim 1, further comprising:
an object catcher in fluid communication with said through passage;
said objects when released from said valve member landing in said object catcher.

20. The at least one sub of claim 1, further comprising:
at least one uphole and a downhole circulating sub on the string;
said downhole sub operated first by at least one first object that passes through said uphole circulating sub to open or close the lateral port of said downhole circulating sub before being ejected to said catcher;
said uphole sub receiving at least one second object larger than said first object for opening or closing the lateral port of said uphole circulation sub.

* * * * *